US008869360B1

(12) United States Patent
Smith

(10) Patent No.: US 8,869,360 B1
(45) Date of Patent: Oct. 28, 2014

(54) BODY BAG

(71) Applicant: Christopher L. Smith, McHenry, IL (US)

(72) Inventor: Christopher L. Smith, McHenry, IL (US)

( * ) Notice: Subject to any disclaimer, the term of this patent is extended or adjusted under 35 U.S.C. 154(b) by 0 days.

(21) Appl. No.: 13/737,432

(22) Filed: Jan. 9, 2013

(51) Int. Cl.
*A61G 1/00* (2006.01)
*A61G 17/06* (2006.01)

(52) U.S. Cl.
CPC ..... *A61G 17/06* (2013.01); *Y10S 224/934* (2013.01)
USPC ..... 27/28; 383/66; 383/117; 224/934

(58) Field of Classification Search
USPC ..... 27/28; 383/66, 67, 73, 102, 117; 493/212–214, 186; 224/157, 158, 934
See application file for complete search history.

(56) References Cited

U.S. PATENT DOCUMENTS

| | | | | |
|---|---|---|---|---|
| 4,388,739 | A | 6/1983 | Martinon et al. | |
| 4,790,051 | A * | 12/1988 | Knight | 27/28 |
| 4,922,562 | A * | 5/1990 | Allred et al. | 5/627 |
| 5,659,933 | A | 8/1997 | McWilliams | |
| 6,004,034 | A * | 12/1999 | Salam | 383/66 |
| 6,092,702 | A | 7/2000 | Cassidy, IV | |
| 6,305,876 | B1 * | 10/2001 | Yoshino et al. | 405/17 |
| 6,467,665 | B1 | 10/2002 | Jenkins | |
| 6,478,464 | B1 | 11/2002 | Miller | |
| 5,659,933 | C1 | 4/2006 | McWilliams | |
| 7,228,603 | B2 * | 6/2007 | Craig | 27/28 |
| 7,337,511 | B2 * | 3/2008 | Yu et al. | 27/28 |
| 7,484,275 | B2 * | 2/2009 | Carroll et al. | 27/28 |
| 8,146,217 | B2 | 4/2012 | Jensen et al. | |
| 2010/0003887 | A1 * | 1/2010 | Greene | 446/75 |

FOREIGN PATENT DOCUMENTS

| | | | |
|---|---|---|---|
| GB | 2476651 | A | 7/2011 |
| WO | WO 2009/061850 | A1 | 5/2009 |

OTHER PUBLICATIONS

Paper Pak Industries. API 6 See Recovery—Rugged Body Bag Improves Water Recoveries www.paperpakaps.com 1941 White Avenue, LaVerne, CA 91750.
Homeland Security Science and Technology Underwater Body Bags (AEI reference No. 03WA-01.BAGS) www.rkb.us/saver.
Post Mortem Underwater Body Bag—Med-Tech Resource Inc. Online Store.

* cited by examiner

*Primary Examiner* — William Miller
(74) *Attorney, Agent, or Firm* — Mathew R. P. Perrone, Jr.

(57) ABSTRACT

A body bag is usually rectangular and has an open end, with the other sides being closed and secured, the material thereof being porous to water, being incapable absorbing or containing water, while preventing viewing of any contents therein. The body bag of this invention is formed of a porous material, which prevents viewing of the body contained therein, while permitting water to pass therethrough. The material may be plastic or fiber.

16 Claims, 5 Drawing Sheets

BODY BAG

This invention relates to a body bag and more particularly to a body bag for recovering a body found underwater.

BACKGROUND OF THE INVENTION

When a body of a deceased person is found under water in a body of water large enough to cover or submerge the remains of that person, recovery thereof is difficult at best. Many times, it is very desirable to place the deceased person in a body bag, while that deceased person is still in the water. No current body bag provides a good method of recovery for that purpose.

One type of body bag is open on three sides, and is further closeable by a fastener, such as a zipper. Any fastener, including a zipper, is difficult to use in the water. This procedure is further complicated by attempting to keep or to put the found body in the bag at the same time, the diver in the water attempts to keep a body in the bag, while trying to close bag.

To keep water in the bag, after recovery, is undesirable. Not only is there added weight, the water makes the bag clumsier and more difficult to handle. Thus, it is very desirable to remove the water therefrom or permit the water to flow out of the bag. It is also useful for the material from which the body bag is made to be water resistant or water repellant.

Most of the current body bags are difficult to open in the water. Yet the open position is required for insertion of the body. The difficulty of achieving the open position, therefore, greatly compounds the problems of using the bag in water.

SUMMARY OF THE INVENTION

Among the many objectives of the present invention is the provision of a body bag, which is easily positioned around a deceased person found in a body of water, while that deceased person is still in the water.

Another objective of the present invention is the provision of a body bag, which is easily held open to receive a deceased person, while in a body of water.

Yet another objective of the present invention is the provision of a body bag, which is easily closed after receiving a deceased person, while in a body of water.

Still another objective of the present invention is the provision of a body bag, which is easily accessible by a person leaving a body of water.

Also an objective of the present invention is the provision of a body bag, which is easily drained of water while the body bag is being removed from a body of water.

These and other objectives of the invention (which other objectives become clear by consideration of the specification, claims and drawings as a whole) are met by providing a body bag with an open end and the other sides being closed and secured, the material thereof being porous to water, incapable absorbing or containing water and preventing viewing of any contents therein.

BRIEF DESCRIPTION OF DRAWINGS

Throughout the figures of the drawings, where the same part appears in more than one figure of the drawings, the same number is applied thereto.

DESCRIPTION OF THE PREFERRED EMBODIMENTS

Figure 1:
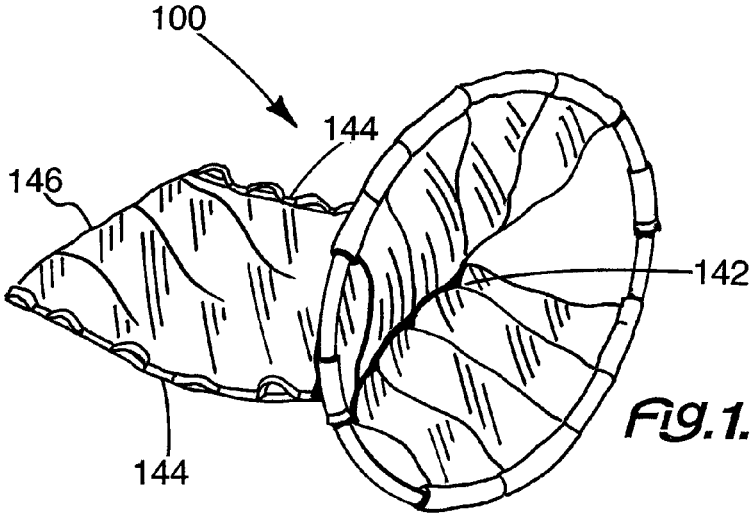
FIG. 1 depicts body bag 100 of this invention deployed for use.

Reference will now be made in detail to several embodiments of the invention that are illustrated in accompanying drawings. Whenever possible, the same or similar reference numerals are used in the drawings and the description to refer to the same or like parts or steps. The drawings are in simplified form and are not to precise scale. For purposes of convenience and clarity only, directional terms such as top, bottom, left, right, up, down, over, above, below, beneath, rear, and front, may be used with respect to the drawings. These and similar directional terms are not to be construed to limit the scope of the invention in any manner. The words attach, connect, couple, and similar terms with their inflectional morphemes do not necessarily denote direct or intermediate connections, but may also include connections through mediate elements or devices.

The body bag of this invention is formed of a porous material, which prevents viewing of the body contained therein, while permitting water to pass therethrough. The body bag may contain a deceased human being or an animal. The material may be plastic or fiber. The fiber is strong but loosely woven, so as not to absorb or contain excess water in either the material from which the bag is formed or the bag itself.

This body bag is therefore very suitable for recovering a deceased person from a body of water. Not only can the body be concealed, water is not contained in the bag, thereby simplifying recovery of the body. The body bag is closed on three sides, and has handles along at least one, and preferably all of the closed sides.

While the body bag is preferably and substantially rectangular, it does have an end which may be propped open with an appropriate end device, and closed by that end device when necessary. The end, which may be propped open, is preferably arced when closed, and preferably circular when opened. The end device accomplishes both of these goals.

When providing an open position for the body bag, the end or propping device is preferably circular. When providing a closed position for the body bag, the end device forms two half circles and appears with folded adjoining arcs. Such a closed position can conceal a body in the bag. Such concealment can minimize emotional trauma for untrained observers or friends of the deceased.

The other three sides of the body bag are closed permanently or fixedly. Such a structure can be accomplished in any suitable fashion. The material may be folded, sewed, glued, heat sealed or secured or secured in any other suitable manner.

Referring now to FIG. 1, body bag 100 has a receiving end 142 on oppositely disposed from a sealed end 146 of substantially the same size. Oppositely disposed closed sides 144 provide the body bag 100 by in combination with sealed end 146 and receiving end 142. Receiving end 142 may be held open or closed with collapsible ring 116. Typically, sealed end 146 and receiving end 142 are shorter than oppositely disposed closed sides 144, to provide a substantially rectangular shape for body bag 100, when closed, except for the arced receiving end 142.

Figure 2:
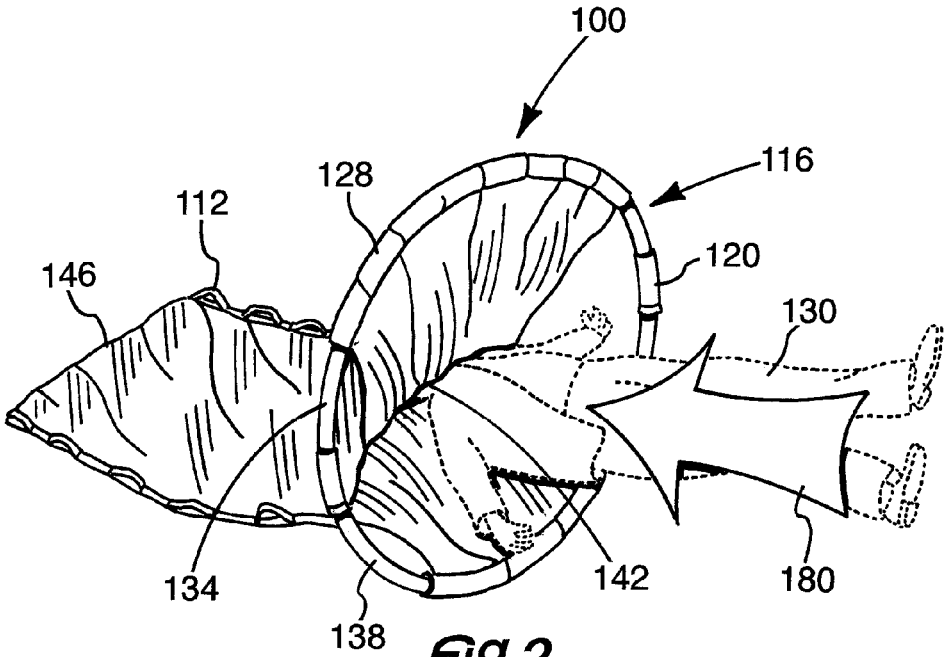
FIG. 2 depicts body bag 100 of this invention having an ease of use with body or remains 130 entering the receiving end 142.
Figure 3:
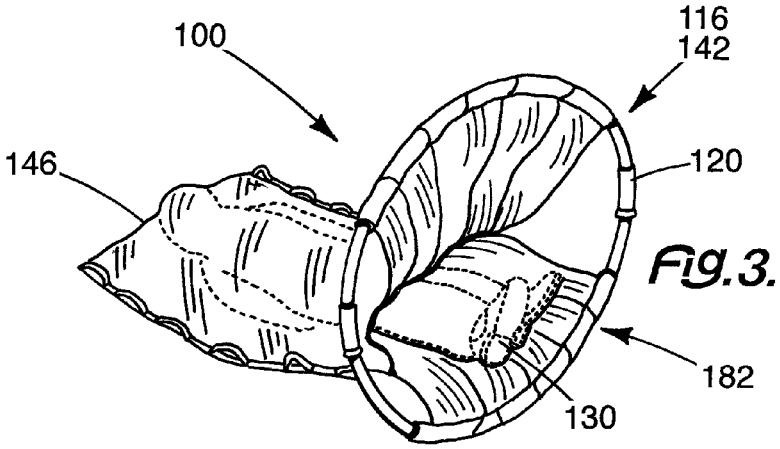
FIG. 3 depicts body or remains 130 inside body bag 100.

Adding FIG. 2 and FIG. 3 to the consideration, grip handles 112 are secured on the oppositely disposed closed sides 144. The propping device or collapsible ring 116 is positioned around the receiving end 142. Lock sleeves 120 are preferably diametrically opposed on collapsible ring 116. Collapsible ring 116 fits into material sleeves 128 at receiving end 142, and is thereby attached to body bag 100. In this manner, body or remains 130 may be inserted into body bag 100 while collapsible ring 116 holds body bag 100 open at receiving end 142. FIG. 2 shows a partial body insertion 180 into body bag 100, while FIG. 3 shows a full body insertion 182. Usually a body bag 100 is used only once before disposal.

Figure 4:
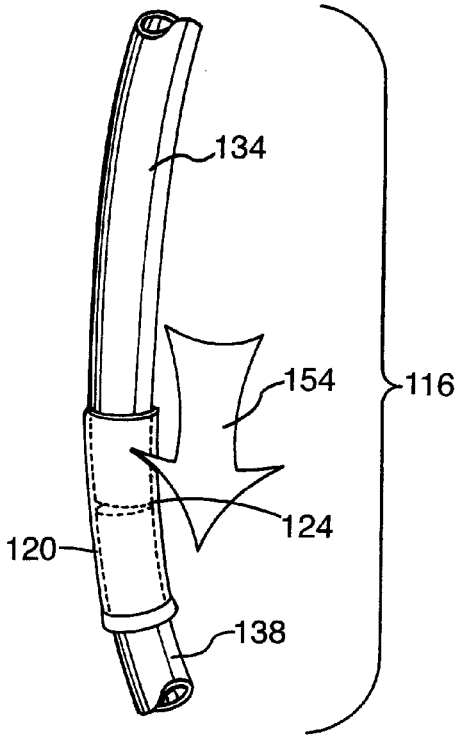
FIG. 4 depicts a collapsible ring 116 for body bag 100 in a locked position 154.

Turning now to FIG. 4, the functioning of collapsible ring 116 is shown. A lock sleeve 120 on collapsible ring 116 keeps hinge 124 from permitting movement of top ring position 134 relative to bottom ring position 138, thereby holding collapsible ring 116 in a substantially circular pattern, and providing a locked position 154.

Figure 5:
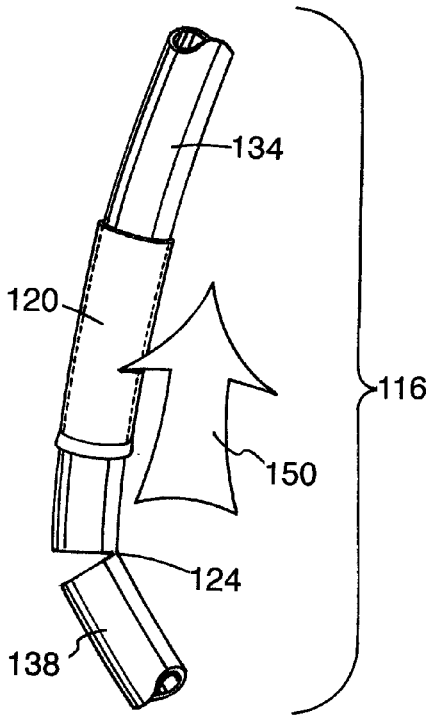
FIG. 5 depicts a collapsible ring 116 for body bag 100 in unlocked position 150.

Comparing FIG. 4 to FIG. 5, lock sleeve 120 is moved to unlocked position 150. In this manner, lock sleeve 120 on collapsible ring 116 permits hinge 124 to allow movement of top ring position 134 relative to bottom ring position 138, thereby permitting collapsible ring 116 to fold in half and close body bag 100.

Figure 6:
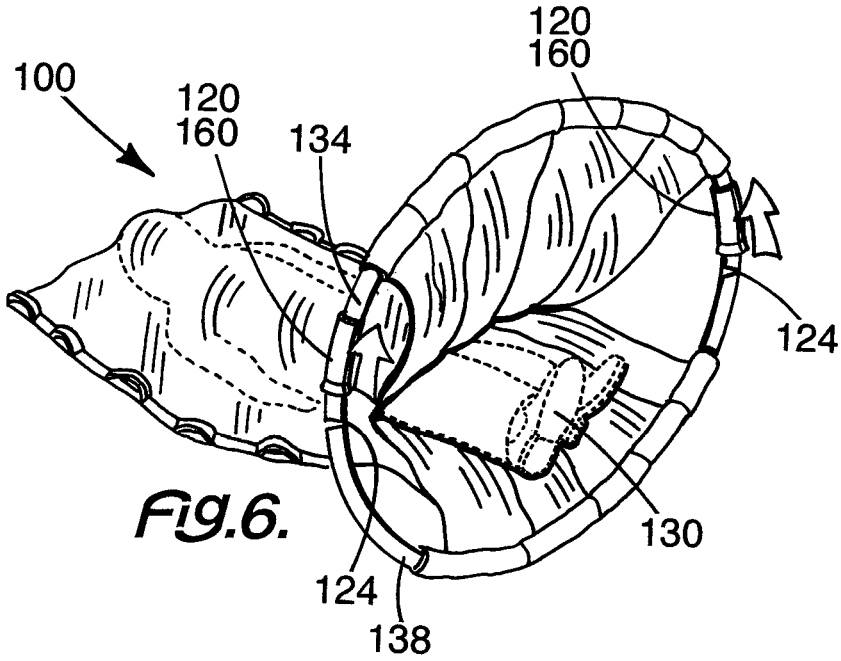
FIG. 6 depicts body bag 100 of this invention with body or remains 130 collected and collapsible ring 116 prepared to be closed in order to form transport mode 166.
Figure 7:
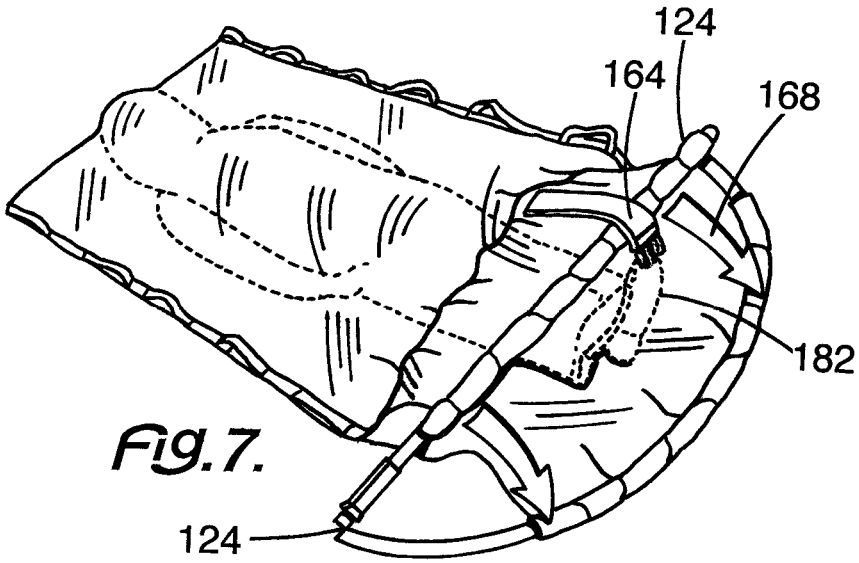
FIG. 7 depicts body bag 100 of this invention having an approaching closed position 168 using hinge 124.
Figure 8:
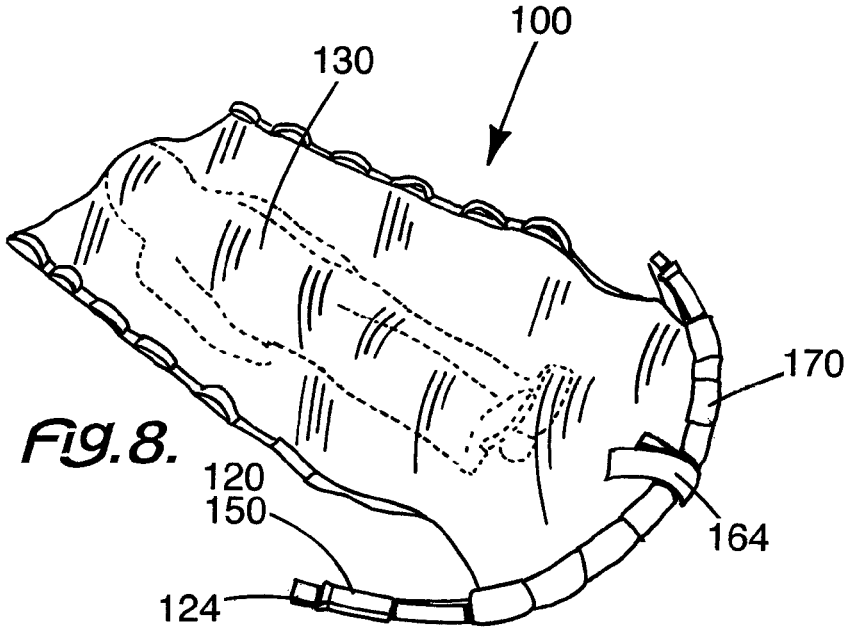
FIG. 8 depicts body bag 100 of this invention having a completely closed position 170 and ready for transport mode 166.

Now adding FIG. 6, FIG. 7 and FIG. 8 to the consideration, the use of body bag 100 becomes more clear. Collapsible ring 116 has each lock sleeve 120 in unlocked position 150, thereby permitting hinge 124 to let top ring position 134 fold onto bottom ring position 138, while material sleeves 128 cooperate with collapsible ring 116, in order to permit closing of body bag 100, in order to contain body or remains 130 therein.

Grip handles 112 facilitate movement of body bag 100 with body or remains 130 therein. Fastening strap 164 comes into play as top ring position 134 folds onto bottom ring position 138 and permits approaching closed position 168 (FIG. 7) due to full body insertion 182. Completely closed position 170 permits fastening strap 164 to come into play and hold body bag 100 in that desired position.

Considering FIG. 8, grip handles 112 and material sleeves 128 may be secured to body bag 100 in any suitable fashion. Grip handles 112 and material sleeves 128 may be secured to a desired location on the body bag 100 in any suitable fashion. Each may be sewn, heat seat sealed, glued or attached in any desired manner. Grip handles 112 are preferably on the closed sides 144 of body bag 100. Material sleeves 128 receive and support collapsible ring 116 on body bag 100, thus collapsible ring 116 to close body bag 100, when it is desired to do so.

Figure 9:
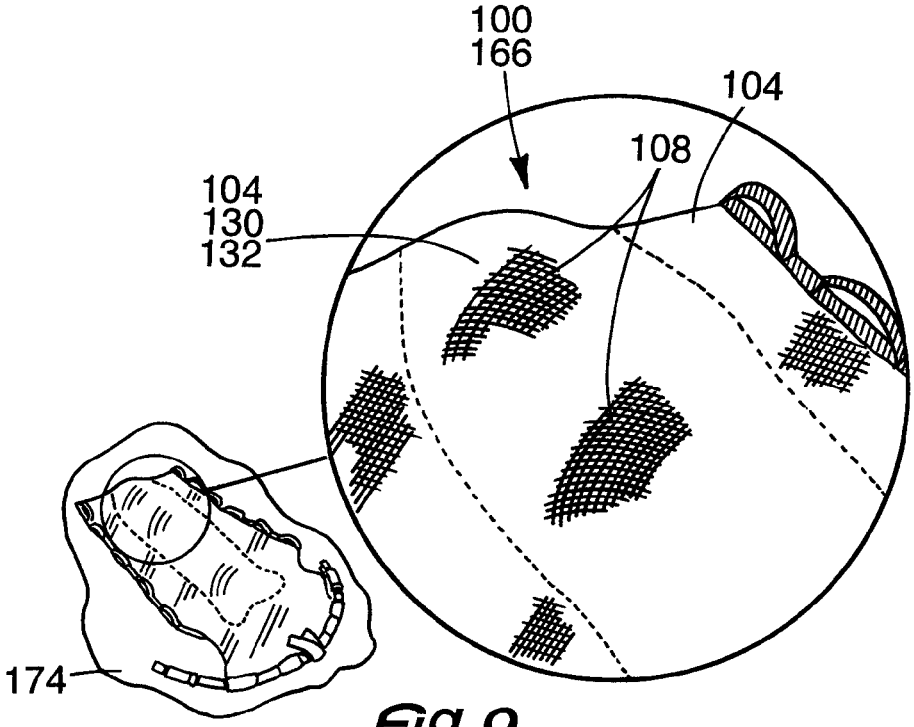
FIG. 9 depicts an enlarged view of facial area 132 of body or remains 130, which cannot be distinguished through material 104.

In FIG. 9, body or remains 130 include facial area 132. Material 104 has weave 108, which permits body bag 100 to conceal the identity of body or remains 130, while allowing water to depart therefrom as body bag 100 with body or remains 130 therein. This decrease in weight permits easier handling thereof.

Figure 10:
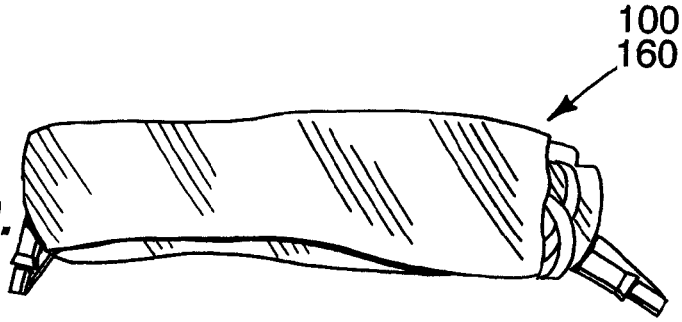
FIG. 10 depicts body bag 100 in rolled up or stored position 160.

With FIG. 10, the storage of body bag 100 becomes clear. Material 104 with weave 108 reaches a rolled up stored position 160 as it is rolled over collapsible ring 116 (FIG. 5) collapsible ring 116 to fold in half and close body bag 100. It is preferred, however, to transport body bag 100, particularly as shown in FIG. 1, with possibly material 104 folded, but with collapsible ring 116 in the open position. The requirement that material 104 not retain or absorb water, while at the same time not permitting the contents of the body bag 100 to be viewed, indicates that position shown in FIG. 1 is desired for transport thereof.

Figure 11:
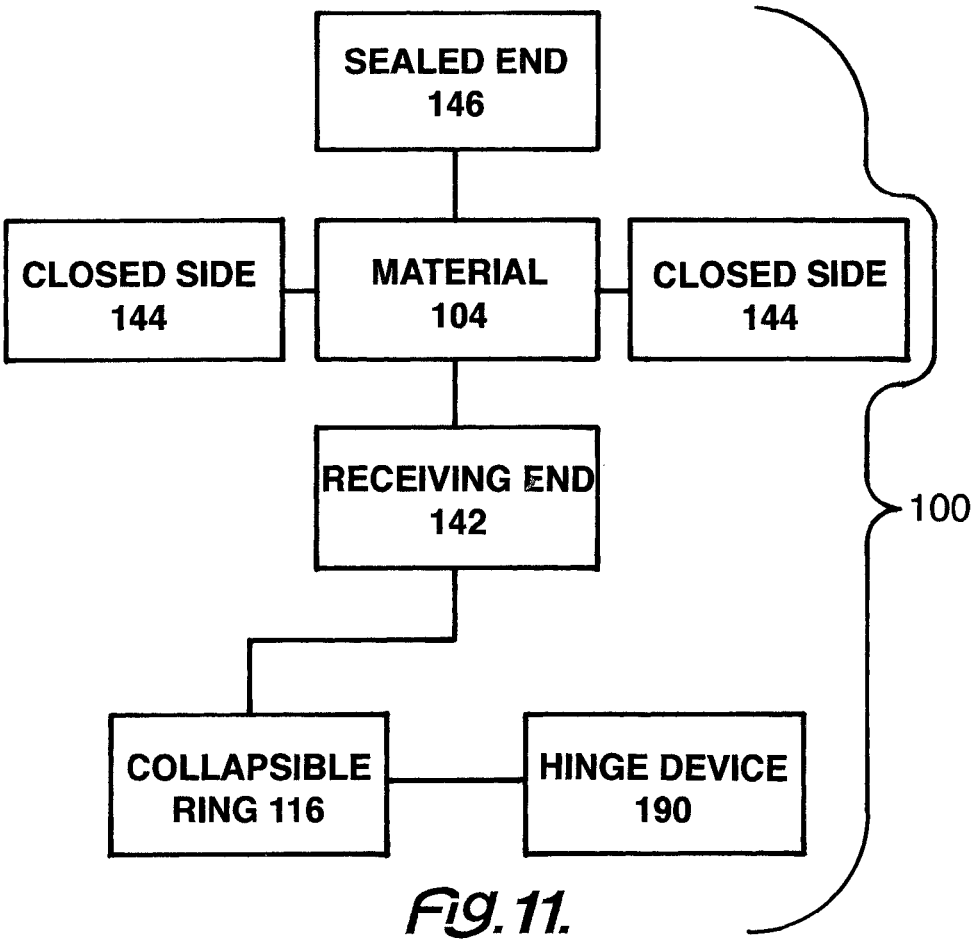
FIG. 11 depicts body bag 100 of this invention in a block diagram.

Turning now to FIG. 11, body bag 100 is formed of material 104, with collapsible ring 116 at a receiving end 142 of body bag 100. Closed sides 144 extend from each side receiving end 142 and terminate in sealed end 146. Hinge device 190 permits collapsible ring 116 to be folded and close body bag 100, or circular to open receiving end 142 of body bag 100.

One example of hinge device 190 is found in FIG. 6 with lock sleeve 120 for hinge 124, shown used in pairs. Hinge device 190 may be any suitable device, which permits the collapsible ring 116 to be folded, held open, or move to points therebetween.

This application—taken as a whole with the abstract, specification, claims, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this tool can become clear to a person having ordinary skill in this particular art. Such modifications are clearly covered by this disclosure.

What is claimed and sought to be protected by Letters Patent is:

1. A body bag for retrieving a deceased person from a body of water comprising:

a) the body bag having an openable end and a secured area therein;

b) the openable end having an opened position and a closed position;

c) the body bag being formed of a material which is porous to water, incapable of absorbing water, and preventing viewing of any contents therein such that the body bag is suitable for recovering the deceased person from the body of water in concealed fashion with limited weight added to the body bag by water, thereby simplifying recovery of the deceased person;

d) the body bag being substantially rectangular shaped thereby defining four peripheral edges;

e) the body bag having the openable end at one edge thereof and being sealed at the other three edges;

f) the body bag having grip handles secured along at least one of the other three edges; and g) the openable end including a propping device, which operates to hold the openable end in the opened position for receiving the deceased person.

2. The body bag of claim 1 further comprising:

a) the propping device being circular when the openable end is in the opened position; and b) the propping device showing two, folded adjoining arcs when the openable end is in the closed position.

3. The body bag of claim 2 further comprising:
a) the other three sealed edges being glued, welded, sewn or formed by a fabric fold; and
b) the openable end being a receiving end for receiving the deceased person.

4. The body bag of claim 3 further comprising:
a) the propping device being a collapsible ring positioned around the receiving end;
b) the collapsible ring being held at the receiving end by at least one material sleeve secured to the receiving end; and
c) the collapsible ring having a first hinge device diametrically opposed from a second hinge device in order to permit folding of the collapsible ring when the receiving end is to be closed, and holding a ring shape when use of the body bag is desired.

5. The body bag of claim 4 further comprising:
a) a first locking sleeve being on the collapsible ring for the first hinge;
b) a second locking sleeve being on the collapsible ring for the second hinge; and
c) the first locking sleeve and the second locking sleeve holding the collapsible ring in the ring shape or permitting folding thereof.

6. The body bag of claim 5 further comprising:
a) the collapsible ring having a top ring position and a bottom ring position, thereby permitting the collapsible ring to fold in half and close the receiving end;
b) the collapsible ring using the first locking sleeve and the second locking to hold the top ring position and the bottom ring position in the ring shape, thereby holding the receiving end open when desired; and
c) the receiving end further including a fastening strap to hold the top ring position and the bottom ring position in adjoining arcs and close the receiving end when desired.

7. The body bag of claim 6 further comprising:
a) the grip handles being secured on at least two oppositely disposed edges of the other three edges;
b) the first locking sleeve and the second locking sleeve being slidable on the collapsible ring; and
c) the grip handles facilitating movement of the body bag.

8. The body bag of claim 7 further comprising:
a) the material being fiber; and
b) the fiber being strong but loosely woven, so as not to absorb water.

9. In a body bag for retrieving a deceased person from a body of water, the improvement comprising:
a) the body bag having an openable end and a secured area therein;
b) the openable end having an opened position and a closed position;
c) the body bag being formed of a material which is porous to water, incapable of absorbing water, and preventing viewing of any contents therein such that the body bag is suitable for recovering the deceased person from the body of water in concealed fashion with limited weight added to the body bag by water, thereby simplifying recovery of the deceased person;
d) the body bag being substantially rectangular shaped thereby defining four peripheral edges;
e) the body bag having the openable end at one edge thereof and being sealed at the other three edges;
f) the body bag having grip handles secured along at least one of the other three edges; and
g) the openable end including a propping device, which operates to hold the openable end in the opened position for receiving the deceased person.

10. The body bag of claim 9 further comprising:
a) the propping device being circular when the openable end is in the opened position; and
b) the propping device showing two, folded adjoining arcs when the openable end is in the closed position.

11. The body bag of claim 10 further comprising:
a) the other three sealed edges being glued, welded, sewn or formed by a fabric fold; and
b) the openable end being a receiving end for receiving the deceased person.

12. The body bag of claim 11 further comprising:
a) the propping device being a collapsible ring positioned around the receiving end;
b) the collapsible ring being held at the receiving end by at least one material sleeve secured to the receiving end; and
c) the collapsible ring having a first hinge device diametrically opposed from a second hinge device in order to permit folding of the collapsible ring when the receiving end is to be closed, and holding a ring shape when use of the body bag is desired;
d) a first locking sleeve being on the collapsible ring for the first hinge;
e) a second locking sleeve being on the collapsible ring for the second hinge; and
f) the first locking sleeve and the second locking sleeve holding the collapsible ring in the ring shape or permitting folding thereof.

13. The body bag of claim 12 further comprising:
a) the collapsible ring having a top ring position and a bottom ring position, thereby permitting the collapsible ring to fold in half and close the receiving end;
b) the collapsible ring using the first locking sleeve and the second locking to hold the top ring position and the bottom ring position in the ring shape, thereby holding the receiving end open when desired; and
c) the receiving end further including a fastening strap to hold the top ring position and the bottom ring position in adjoining arcs and close the receiving end when desired.

14. The body bag of claim 13 further comprising:
a) the grip handles being secured on at least two oppositely disposed edges of the other three edges;
b) the first locking sleeve and the second locking sleeve being slidable on the collapsible ring; and
c) the grip handles facilitating movement of the body bag.

15. The body bag of claim 14 further comprising:
a) the material being fiber; and
b) the fiber being strong but loosely woven, so as not to absorb water.

16. A method of recovering a deceased person from a body of water comprising:
a) providing a body bag, which receives contents without retaining water therein;
b) providing the body bag with an openable end and a secured area therein;
c) providing the openable end with an opened position and a closed position;
d) forming the body bag of material which is porous to water, incapable of absorbing water and prevents viewing of the contents therein;
e) forming the body bag as substantially a rectangle;
f) having the openable end lead to three closed sides of the rectangle;
g) providing grip handles secured along at least two of the three sides; and h) providing a propping device at the openable end, which operates to hold the openable end in the opened position for receiving the deceased body.

* * * * *